US006302668B1

(12) United States Patent
Lee

(10) Patent No.: US 6,302,668 B1
(45) Date of Patent: Oct. 16, 2001

(54) CAPACITY REGULATING APPARATUS FOR COMPRESSORS

(75) Inventor: Liang-Chen Lee, Taipei (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 0 days.

(21) Appl. No.: 09/643,740

(22) Filed: Aug. 23, 2000

(51) Int. Cl.[7] ..... F01C 1/24
(52) U.S. Cl. ..... 418/201.2
(58) Field of Search ..... 418/201.2

(56) References Cited

U.S. PATENT DOCUMENTS

| | | | | |
|---|---|---|---|---|
| Re. 29,283 | * | 6/1977 | Shaw | 418/201.2 |
| 3,088,659 | * | 5/1963 | Nilsson et al. | 418/201.2 |
| 3,432,089 | * | 3/1969 | Schibbye | 418/201.2 |
| 3,936,239 | * | 2/1976 | Shaw | 418/206.2 |
| 4,080,110 | * | 3/1978 | Szymaszek | 418/201.2 |
| 4,249,866 | * | 2/1981 | Shaw et al. | 418/201.2 |
| 4,388,048 | * | 6/1983 | Shaw et al. | 418/201.2 |
| 4,412,788 | * | 11/1983 | Shaw et al. | 418/201.2 |
| 4,519,748 | * | 5/1985 | Murphy et al. | 418/201.2 |
| 4,727,725 | * | 3/1988 | Nagata et al. | 418/201.2 |
| 6,082,985 | * | 7/2000 | Suzuki et al. | 418/201.2 |

FOREIGN PATENT DOCUMENTS

| | | | | |
|---|---|---|---|---|
| 1628382 | * | 1/1970 | (DE) | 418/201.2 |
| 19512950 | * | 10/1996 | (DE) | 418/201.2 |
| 464316 | * | 1/1992 | (EP) | 418/201.2 |
| 57-195890 | * | 12/1982 | (JP) | 418/201.2 |
| 57-206794 | * | 12/1982 | (JP) | 418/201.2 |
| 59-119084 | * | 7/1984 | (JP) | 418/201.2 |
| 59-119085 | * | 7/1984 | (JP) | 418/201.2 |
| 02-248677 | * | 10/1990 | (JP) | 418/201.2 |
| 04-058092 | * | 2/1992 | (JP) | 418/201.2 |

* cited by examiner

*Primary Examiner*—Thomas Denion
*Assistant Examiner*—Theresa Trieu
(74) *Attorney, Agent, or Firm*—Rosenberg, Klein & Lee

(57) ABSTRACT

An improved capacity regulating apparatus for compressors is disclosed. The design comprises a chamber, a sliding member coupled to the chamber and a pair of rotors abutting to and below the sliding member. A piston disposed in the cylinder and the sliding member are coupled to a rod, enabling the sliding member to move axially along a portion of the rod. Two opposite guide slots are provided in opposite sides of the sliding member. A lateral slot is provided inside the sliding member to allow the guide slots in communication with each other; also, an axial slot, extending through a bottom wall of the sliding member, is provided inside the sliding member. Hence, a pressure cushion is formed by the high pressure flow coming from the cylinder to the axial and lateral slots then to the opposite guide slots and enables the sliding member to suspend above the rotors and in the motion barrel, thereby maintaining the siding member to move in the central portion of the motion barrel, reducing the undesirable friction and minimizing the effects of misalignments.

6 Claims, 7 Drawing Sheets

CAPACITY REGULATING APPARATUS FOR COMPRESSORS

BACKGROUND OF THE INVENTION (1) Field of the Invention

The invention generally relates to a capacity regulating apparatus for compressors, and more particularly to a compressor that in the capacity regulating process the undesirable friction between the relevant parts may be reduced to a minimal level and the unwanted effects due to the misalignments between the relevant parts may be minimized so that a compressor can operate more smoothly and its efficiency may be increased.

(2) Description of the Prior Art

The capacity regulator, and hence the load level, of the compressors available on the market for the present time is typically achieved by the adjustment of the relative orientation between the sliding member and the two rotors. The sliding member is housed in a motion barrel and is coupled to the rod. Also, the piston and the sliding member are fixedly attached to the rod. A misalignment amongst the sliding member, the piston and the rod occurs easily if the tolerances between these parts are too relatively large.

In addition, the sliding member is housed in the motion barrel of a compressor, and the sliding member makes contact with the rotors and the inner walls of the motion barrel; therefore, a lubricant is applied on these contact surfaces to reduce the friction on these surfaces. Such compressor and the use of lubricant may adversely affect the sliding process of the sliding member easily. Plus, if these is a misalignment between the relevant parts, the sliding member will not be able to smoothly move axially in the motion barrel and a jamming or a malfunction of the sliding may even take place, disabling the chamber adjustment capability of the compressor.

SUMMARY OF THE INVENTION

The main object of the present invention is to provide a compressor in which the aforesaid disadvantages may be reduced to a minimal level by the formation of a pressure cushion, which is formed between the sliding member and the motion barrel, and therefore the unwanted diction between the sliding member and the motion barrel as well as between the sliding member and the two rotors may be reduced to a minimal level. Therefore, a smoother sliding of the sliding member may be ensured.

Another object of the present invention is to provide a compressor in which the sliding member may be centrally maintained in the motion barrel in its sliding motion and hence the misalignments may be reduced to a minimal level.

A further object of the present invention is to provide a compressor in which the sliding member may be allowed to move axially along the rod extending through and coupled with the piston and the sliding member, ensuring a smooth sliding motion of the sliding member.

One more object of the present invention is to provide a compressor in which the appropriate clearances are provided amongst the sliding member, the piston and the rod so that all misalignments or any undesirable relative position shift amongst these three parts may be automatically corrected or counteracted.

BRIEF DESCRIPTION OF THE DRAWINGS

The present invention will now be specified with reference to its preferred embodiments illustrated in the drawings, in which.

DESCRIPTION OF THE PREFERRED EMBODIMENT

Figure 1:
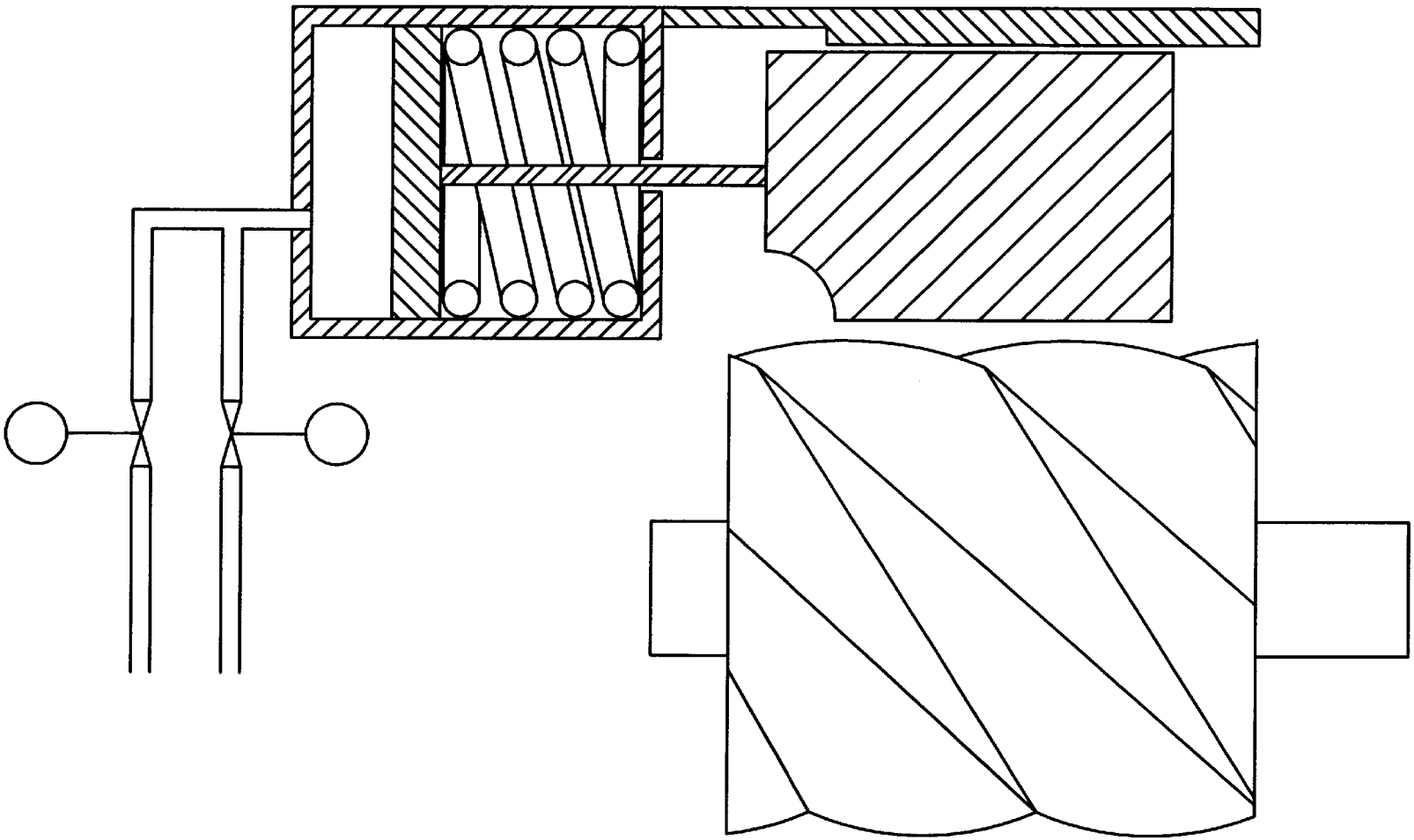
Fig. 1 PRIOR ART
FIG. 1 is a cross-sectional view of a capacity regulating apparatus of the prior art.
Figure 2:
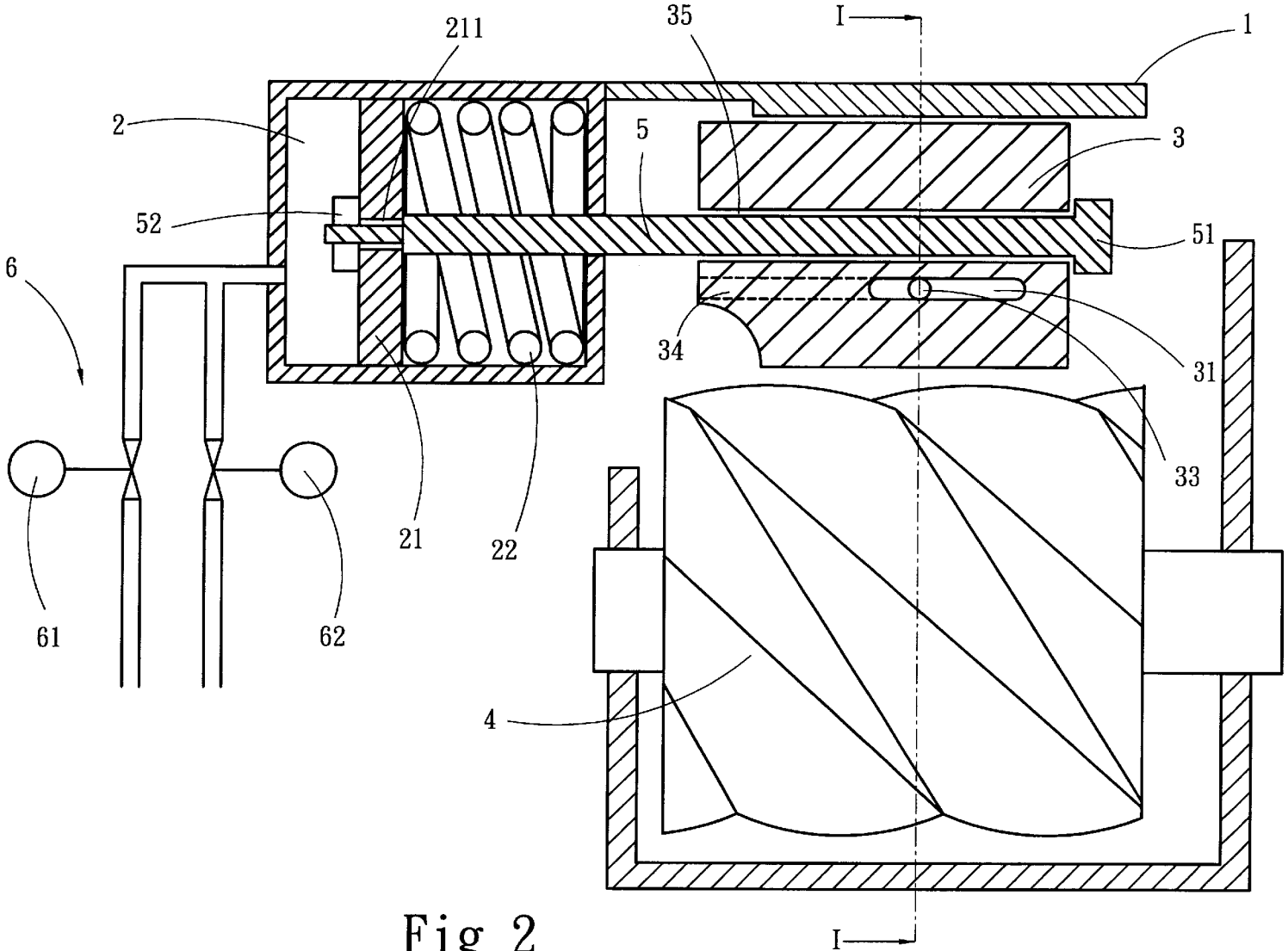
FIG. 2 is a cross-sectional view of a capacity regulating apparatus of the present invention.
Figure 3:
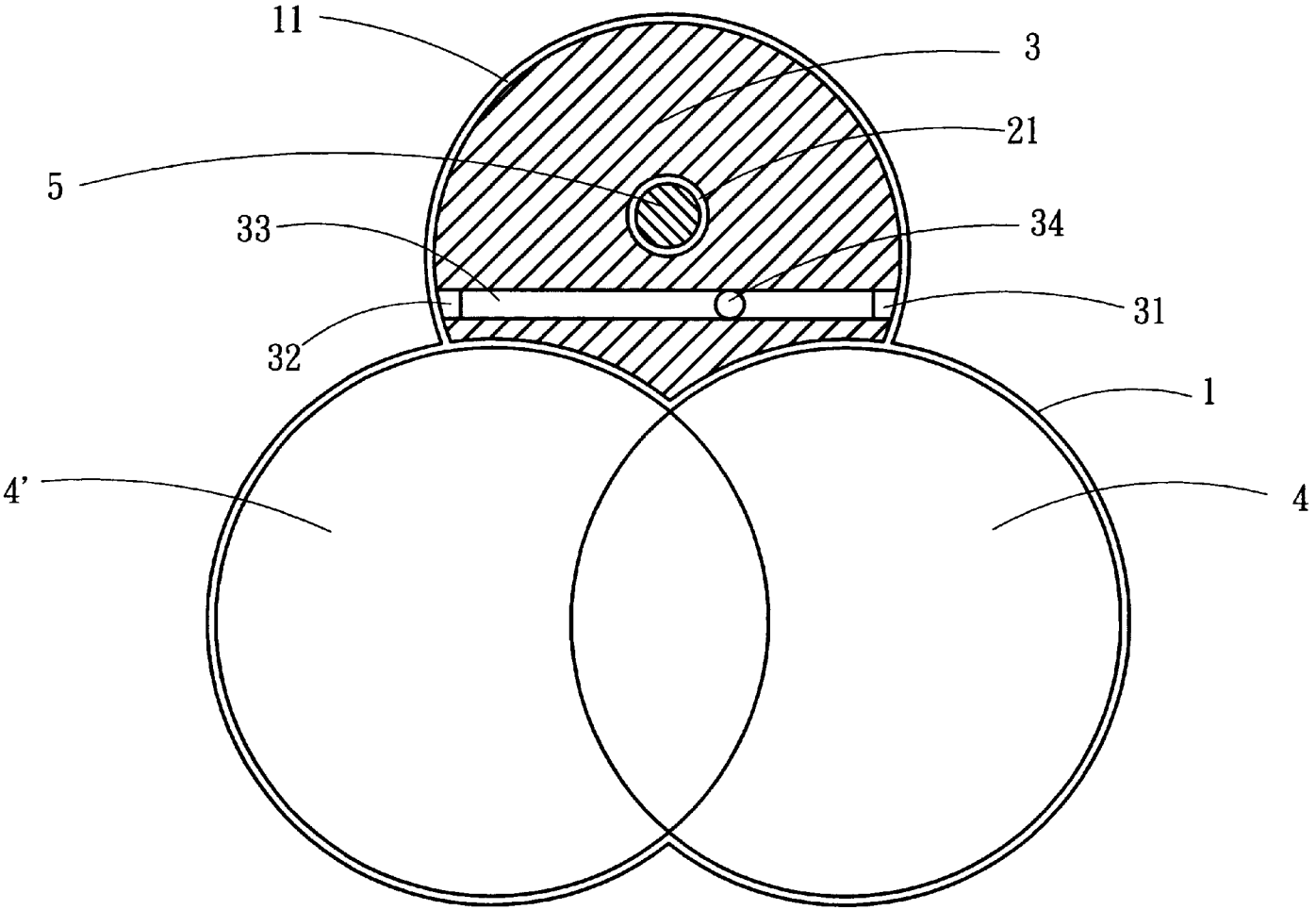
FIG. 3 is a cross-sectional view of a capacity regulating apparatus of FIG. 2 along line I—I.
Figure 4:
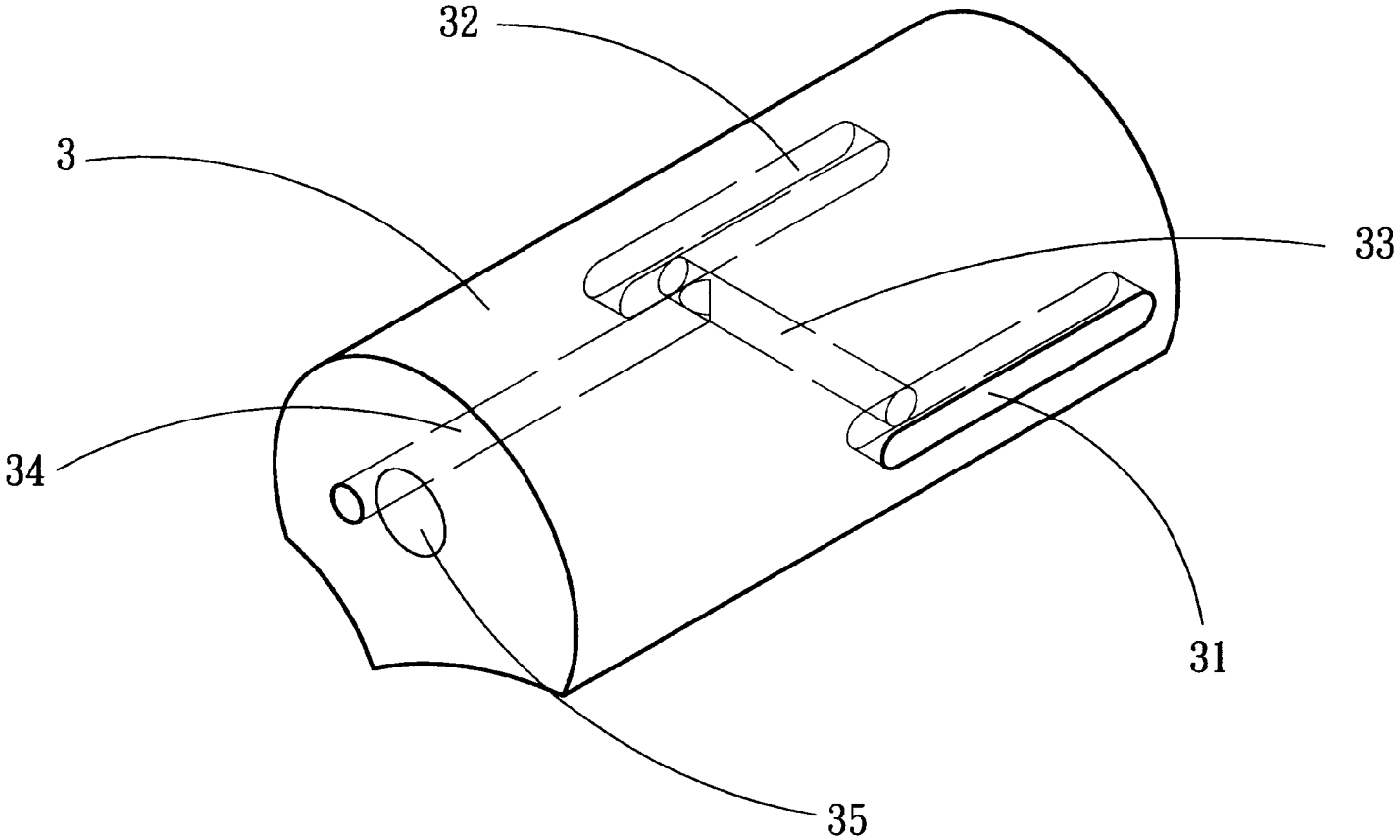
FIG. 4 is a perspective view of a sliding member of the present invention, showing its internal structure.

Please refer to FIGS. 2, 3 and 4, a cross-sectional view of a capacity regulating apparatus of the present invention, a cross-sectional view of a capacity regulating apparatus of FIG. 2 along line I—I and a perspective view of a sliding member of the present invention, respectively. As illustrated in these drawings, the design of the invention is disposed at the appropriate positions in a compressor, which is comprised of a chamber 2, a sliding member 3 connected to the chamber 2 and a pair of rotors that are near and below the said sliding member 3. The sliding member is disposed in the motion barrel 11 and is abutting to the rotors 4, 4'. Two guide slots 31, 32 with an appropriate length are provided in two opposite sides of the sliding member 3 and a lateral slot is provided in the sliding member and connects these two guide slots 31, 32. Further, an axial slot 34 oriented along the axial direction of the sliding member is provided in the sliding member, and one end of the axial slot is in communication with the lateral slot 33 and the another end of the axial slot extends through the bottom wall of the sliding member 3.

A piston 21 is housed in the cylinder chamber 2. An aperture 211 is provided in the piston 21, and another aperture 35 is provided in the sliding member 3. Via the two apertures 211, 35, the piston 21 and the sliding member 3 are fixedly connected to the rod 5, and the sliding member 3 is allowed to move axially along a portion of the rod 5. Also, a flexible member 22 is provided and positioned on the part of the rod between the piston 21 and the three inner walls of the chamber of the cylinder 2. In addition, the outer diameter of the rod 5 is smaller than the inner diameter of each of the two apertures 211, 35, providing the appropriate clearances between the piston 21 and the rod 5 and between the sliding member 3 and the rod 5. Furthermore, a T-shape rod end 51 is provided at the free end of the rod 5 so that the sliding member 3 would not disengage with the rod. Also, a joining member 52 is provided at the other end of the rod 5 so that the piston 21 may be fixedly coupled with the rod 5 and the piston 21 may be prevented from disengagement with the rod 5.

The chamber 2 is in communication with a flow control assembly 6 through the left wall of the cylinder. The flow control assembly 6 comprises a high-pressure electromagnetic valve 61, which may be used to control the high pressure flows, and a low-pressure electromagnetic valve 62, which may be used to control the low pressure flows.

Figure 5:
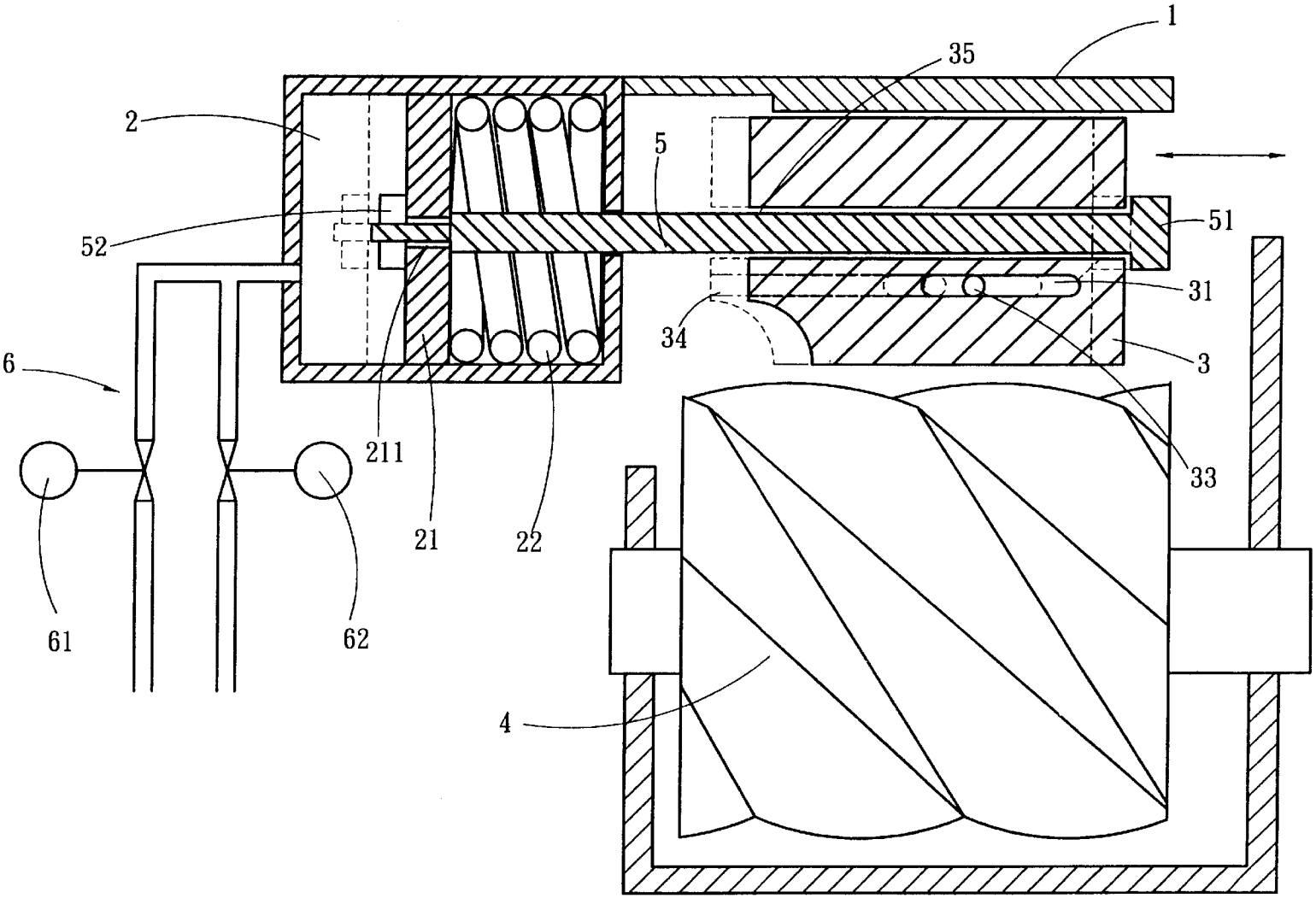
FIG. 5 is a first cross-sectional view of a capacity regulating apparatus of the present invention, showing in its operating condition.
Figure 6:
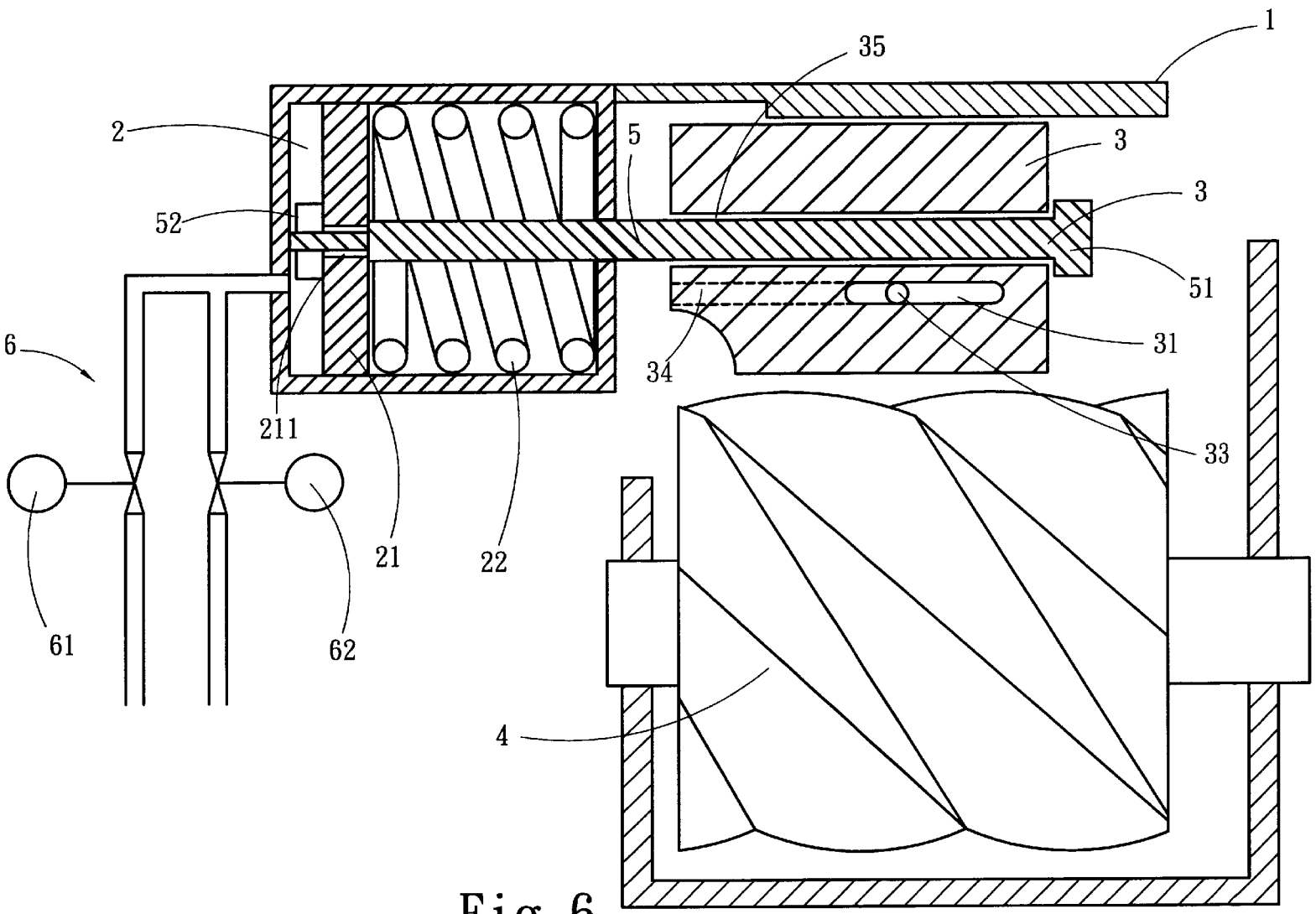
FIG. 6 is a second cross-sectional view of a capacity regulating apparatus of the present invention, showing in its operating condition.
Figure 7:
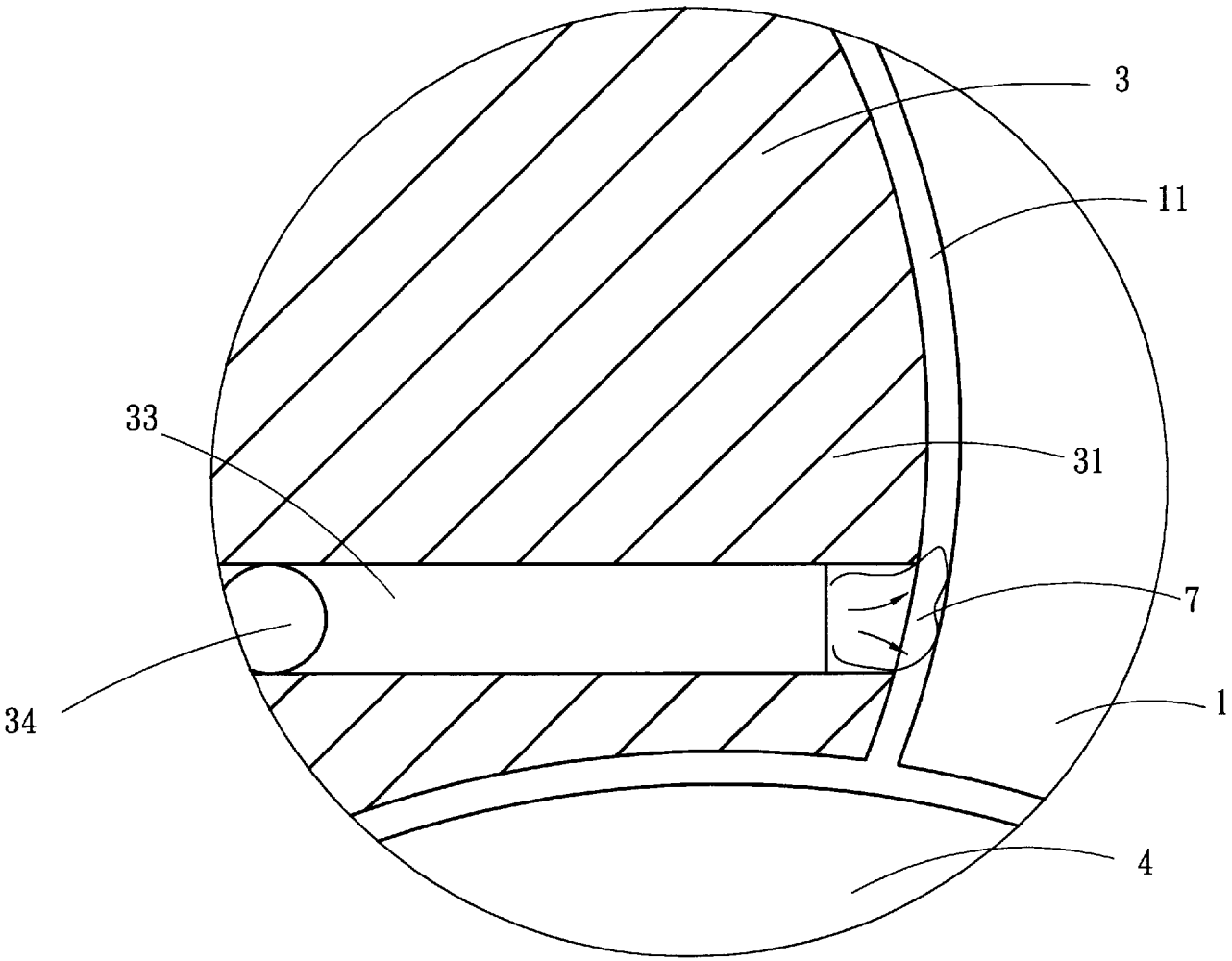
FIG. 7 is a view showing the position where the pressure cushion of the present invention is formed.

Referring now to FIGS. 5, 6 and 7, a first cross-sectional view of a capacity regulating apparatus of the present invention, a second cross-sectional view of a capacity regulating apparatus of the present invention and a view showing the position where the pressure cushion of the present invention is formed, respectively. As a known fact in the art, it would be desirable if the load is reduced to a minimal level when the compressor 1 is actuated. After the compressor 1 is actuated, the load may be gradually increased. Typically, the gas intake amount, and hence the load level, is controlled by the adjustment of the relative orientation of the sliding member 3 and the two rotors 4 and 4'. When a compressor of the present invention is actuated, the high-pressure electromagnetic valve 61 will be activated and the high pressure gas will enter into the chamber 2. This gas will push the piston 21 to the right and decompress the flexible member 22. Now, the sliding member 3 will be pushed to the right too and the distance between the sliding member 3 and the two rotors 4 and 4' is increased. In the mean time, a portion of the high pressure gas will enter into the sliding member 3 through the axial slot 34 and then to the two opposite guide slots located in the sides of the sliding member 3 through the lateral slot 33. Now, some high pressure gas will rush out of the two opposite guide slots 31 and 32 and hence a pressure cushion 7 is formed between the two guide slots 31, 32 and the inner walls of the motion barrel 11. This pressure cushion 7 can lift and suspend the sliding member 3 in the motion barrel 11 and hence reduces the undesirable friction between the sliding member 3 and the two rotors 4 and 4'. Further, the sliding member 3 can move axially along the rod 5 after the piston 21 and sliding member 3 are activated. In addition, the misalignments may be automatically corrected or overcome due to the appropriate clearances provided between the piston 21 and the rod 5 and between the sliding member 3 and the rod 5; therefore, the smooth sliding motion of the sliding member 3 may be ensured and the efficiency of the compressor may be increased. When the compressor is deactivated, a relatively lower pressure is present in the chamber 2 because the gas has been let out of the chamber 2 and a relatively higher pressure is still present at the right to the flexible member 22. Therefore, the piston 21 will be pushed back to its original position due to the pressure difference and the force exerted by the flexible member 22. Also, the sliding member 3 will be returned to its original position due to the T-shape rod end 51 when the sliding member 5 is forced back by the piston 21. Therefore, the relevant parts of the compressor are ready for the next actuation of the compressor.

From the above discussion, by using the present design, it may be appreciated by those skilled in the art that the sliding member 3 may be suspended above the two rotors 4 and 4' as well as in the motion barrel 11; therefore, the friction between the sliding member 3 and the two rotors 4 and 4' may be reduced. Besides, The inability for the sliding member 3 to move smoothly in the motion barrel 11 due to misalignment may be prevented.

Although a preferred embodiment of the present invention has been described in detail in the above, the preferred embodiment and the associated discussion and drawings are to be regarded in an illustrative manner rather than a restrictive manner. It will, however, be evident that various changes and modifications may be made thereunto without departing from the broader spirit and scope of the invention as set forth in the appended claims.

I claim:

1. An improved capacity regulating apparatus for compressors, comprising:

a cylinder disposed in the compressor, having a piston and a flexible member disposed in the cylinder;

a sliding member coupled to the piston, wherein two opposite guide slots being provided in two opposite sides of the sliding member, two passages being provided inside the sliding member and being in communication with each of the two guide slots, one end of the passages extending through a bottom wall of the sliding member;

a pair of rotors abutting to and below the sliding member;

a rod extending through and coupled with the piston and the sliding member; and wherein the sliding member being allowed to move axially along a portion of the rod and hence being able to move smoothly in the motion barrel of the compressor, minimizing the effects of misalignments of the sliding member, the piston, the rod, and, during a capacity regulating apparatus, a pressure cushion formed by the high pressure flow coming from the cylinder to the two passages then to the guide slots enabling the sliding member to suspend above the rotors and in the motion barrel, thereby maintaining the siding member to move in the central portion of the motion barrel and reducing the undesirable friction between the sliding member and the two rotors.

2. The improved capacity regulating apparatus for compressors as in claim 1, wherein the said passages comprising an axial lateral and a lateral slot in communication with the axial slot, and the said lateral slot extending through the opposite sides of the sliding member and being in communication with the two opposite guide slots, the said axial slot extending through the bottom ball of the sliding member.

3. The improved capacity regulating apparatus for compressors as in claim 1, wherein the said piston having an aperture to couple the said piston with the rod, and the diameter of the aperture being larger than the diameter of the rod.

4. The improved capacity regulating apparatus for compressors as in claim 1, wherein the sliding member having an aperture to couple the sliding member with the rod, and the diameter of the aperture being larger than the diameter of the rod.

5. The improved capacity regulating apparatus for compressors as in claim 1, wherein the flexible member being coupled with the rod and being disposed in the space formed by the piston and three walls of the chamber.

6. The improved capacity regulating apparatus for compressors as in claim 5, wherein the flexible member being a spring or other similar member with the same kind of resilient flexibility.

* * * * *